US009322606B2

(12) United States Patent
Hall

(10) Patent No.: US 9,322,606 B2
(45) Date of Patent: Apr. 26, 2016

(54) ADJUSTABLE GAS CYCLIC REGULATOR FOR AN AUTOLOADING FIREARM

(75) Inventor: Corby Hall, New Braunfels, TX (US)

(73) Assignee: F & D Defense LLC, Seminole, OK (US)

( * ) Notice: Subject to any disclaimer, the term of this patent is extended or adjusted under 35 U.S.C. 154(b) by 0 days.

(21) Appl. No.: 13/538,335

(22) Filed: Jun. 29, 2012

(65) Prior Publication Data

US 2014/0000446 A1 Jan. 2, 2014

(51) Int. Cl.
*F41A 19/02* (2006.01)
*F41A 19/03* (2006.01)

(52) U.S. Cl.
CPC ..... *F41A 19/03* (2013.01)

(58) Field of Classification Search
USPC ..... 89/129.01, 129.02, 130, 131, 132, 89/191.01, 191.02, 192, 193; 251/121, 251/122; 137/614.17, 614.18
See application file for complete search history.

(56) References Cited

U.S. PATENT DOCUMENTS

| | | | | | |
|---|---|---|---|---|---|
| 2,003,066 | A * | 5/1935 | Brondby | 89/193 |
| 2,340,293 | A * | 2/1944 | Balleisen | 138/45 |
| 2,715,858 | A * | 8/1955 | Hoppert | 89/193 |
| 2,791,944 | A * | 5/1957 | Harvey | 89/193 |
| 3,127,812 | A * | 4/1964 | Into et al. | 89/193 |
| 3,690,219 | A * | 9/1972 | Muhlemann et al. | 89/193 |
| 4,244,273 | A * | 1/1981 | Langendorfer et al. | 89/193 |
| 4,503,632 | A * | 3/1985 | Cuevas | 42/1.06 |
| 5,272,956 | A * | 12/1993 | Hudson | 89/128 |
| 7,418,898 | B1 | 9/2008 | Desomma | |
| 7,461,581 | B2 | 12/2008 | Leitner-Wise | |
| 7,856,917 | B2 | 12/2010 | Noveske | |
| 7,971,518 | B2 | 7/2011 | Adams | |
| 8,109,196 | B1 * | 2/2012 | Spence | 89/193 |
| 8,261,653 | B2 * | 9/2012 | Crommett | 89/193 |

OTHER PUBLICATIONS http://www.spikestactical.com/new/z/spikes-tactical-enhanced-adjustable-micro-gas-block-625-wset-screw-p-928.html.
http://www.jprifles.com/1.4.6_gs.php.

* cited by examiner

*Primary Examiner* — Gabriel Klein
(74) *Attorney, Agent, or Firm* — Hall Estill Attorneys at Law

(57) ABSTRACT

An adjustable gas valve having an annular body with an inner surface defining a gas chamber and first and second annular end surfaces defining first and second openings of said gas chamber, the gas valve further having outer surface and at least one gas channel extending between the inner surface and the outer surface providing a gas communication path from the outer surface to the gas chamber, wherein said at least one gas channel is orientated to direct fluid egressing from the channel into the chamber along the inner surface. The invention further includes a regulator occupying a portion of the chamber to define a chamber operating volume, the regulator having at least one outer diameter corresponding to an inner diameter of the passage to substantially inhibit gas flow from the pass through the second opening.

14 Claims, 7 Drawing Sheets

ADJUSTABLE GAS CYCLIC REGULATOR FOR AN AUTOLOADING FIREARM

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to autoloading firearms. More specifically, the invention is an apparatus for tuning the gas flow rate and/or timing of an autoloading firearm for different operating conditions.

2. Description of the Related Art

In the field of autoloading firearms, adjustable gas blocks provide means for compensating for regulated gas flow attributable to the use of silencers and various types of loads of ammunition. It is known, for example, that the addition of more gas into the operating systems increases the potential for failure of the autoloading mechanism. Particularly with high-precision autoloading firearms, the ability to fine tune the gas flow characteristics becomes even more important, as even minor differences between ammunition can affect the efficiency of the operation of the autoloading mechanisms.

One patent that shows a system of adjusting gas flow characteristics is U.S. Pat. No. 7,856,917, issued Dec. 28, 2010 to Noveske, which is incorporated by reference herein. Noveske discloses an improved switchblock for use in autoloading firearms that facilitates user adjustment of the gas output. Noting that other designs, such as the ArmaLite AR10 gas block, offer the user the ability to regulate gas flow by toggling a screw between only two positions, Noveske offers three such positions of adjustment: a standard gas flow optimized for a firearm, a reduced gas flow optimized for the firearm when used with a suppressor, and a no-flow position which completely shuts off gas flow.

Other manufacturers offer products that provide the ability to "micro" tune gas flow. For example, Spike Tactical LLC of Apopka, Fla. and JP Enterprises, Inc. of Hug, Minn. offer an adjustable gas block that relies moving a set screw into and out of the volume of the gas block in a direction other than parallel to the longitudinal axis of the volume. Spike Tactical's product is sold under the tradename SUGB130. JP Enterprises's product is sold under the tradename JP Adjustable Gas System.

While Noveske, ArmaLite, Spike Tactical, and JP Enterprises represent improvements over other systems that do not provide a mechanism for adjusting gas flow characteristics, Noveske does not provide fine, indiscrete tuning of such characteristics. And even when providing adjustable positions for regulating, existing systems introduce gas into the gas chamber in a highly turbulent manner that directs the gas directly toward a surface of the gas chamber. This causes the gas to immediately lose significant amount energy while turning ninety-degrees toward the piston assembly, and negatively affects the gas-cyclic efficiency and overall performance of the autoloading firearm.

For high-precision firearms, the pressure and volume flow-rate required to actuate the piston, and thus cause reloading of the firearm, must fall within a given range. When using different bullet types, weights, and load charges, the pressures created by the bullet discharge may fall outside that range, effectively meaning that the firearm will not properly cycle with all loads. Systems such as Noveske, however, do not provide the user with the ability for tuning of the auto-loading mechanism of such high-precision firearms.

BRIEF SUMMARY OF THE INVENTION

The present invention allows virtually unlimited tuning of the gas flow rate for different operating conditions, such as suppressor usage and ammunition type. The invention acts as a delay mechanism by inducing a swirl flow pattern, and/or by providing a means of adjusting the operating volume within a gas valve, thus extending (or otherwise regulating) the gas front's distance of travel within the gas chamber. The delay may be desirable for proper cyclic timing of autoloading firearms, particularly those using a piston-pushrod mechanism. The present invention also substantially reduces gas-flow turbulences associated with the instant ninety-degree transition, thus increasing gas-cyclic efficiency, reducing felt-recoil, and improving accuracy and overall performance of the autoloading firearm.

The invention includes a gas valve having an annular body with an inner surface defining a gas chamber and first and second annular end surfaces defining first and second openings of said gas chamber. The gas valve has an outer surface and at least one gas channel extending between the inner surface and the outer surface providing a gas communication path from the outer surface to the gas chamber. The gas channel is orientated to direct fluid egressing from the channel into the chamber along the inner surface. The invention further includes a regulator occupying a portion of the chamber to define a chamber operating volume, the regulator having at least one outer diameter corresponding to an inner diameter of the passage to substantially inhibit gas flow from the chamber.

DETAILED DESCRIPTION OF EMBODIMENTS OF THE INVENTION

Figure 1:
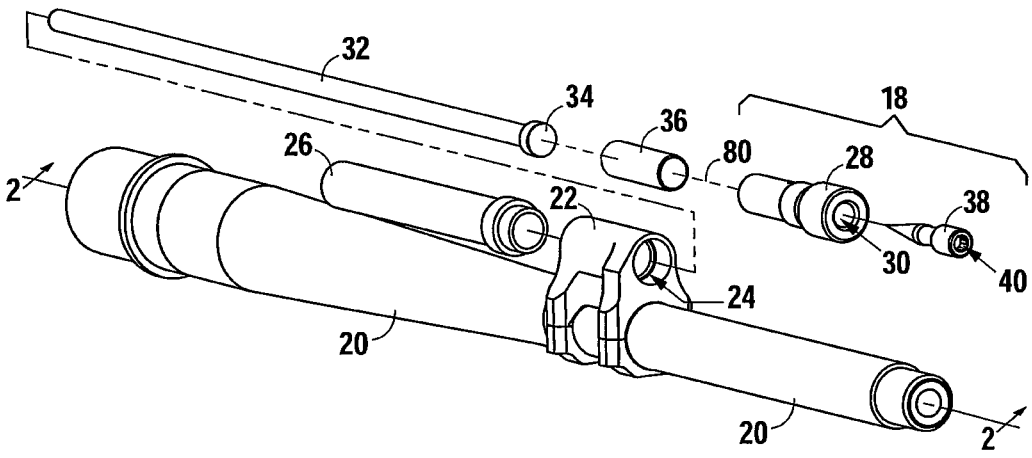
FIG. 1 is an assembly view of an embodiment of the present invention in use with components of an autoloading firearm.

FIG. 1 shows an embodiment 18 of the present invention in connection with components of an autoloading firearm having a barrel 20. The autoloading components include a gas block 22 attached around the barrel 20 that defines a generally cylindrical interior 24, and a gas tube 26 coupled to the gas block 22. A piston rod 32 has a head 34 movable within the gas tube 26. A piston member 36 is also positioned within the gas tube 26 adjacent the piston rod 32 and the gas valve 28. The gas tube 26 is a generally cylindrical hollow body having a partially closed end allowing the piston rod 32 and piston member 36 to cycle therewithin, with the opposing end of the piston rod 32 connected to the remainder of the autoloading mechanism (not shown) to eject the spent casing and load a new round.

The embodiment 18 includes a gas valve 28 that defines a generally cylindrical gas chamber 30. The gas valve 28 is positioned within the interior 24 of the gas block 22. The gas valve 28 is longitudinally fixed but rotatable around an axis 80 relative to the gas block 22. The gas chamber 30 and interior 24 of the gas block 22 are coaxially aligned about the axis 80.

The embodiment further includes a regulator 38 that is at least partially positionable in the gas chamber 30 through an end of the gas valve 28. A drive slot 40 is formed in one end of the regulator 38 for receiving a driving tool (not shown).

Figure 2:
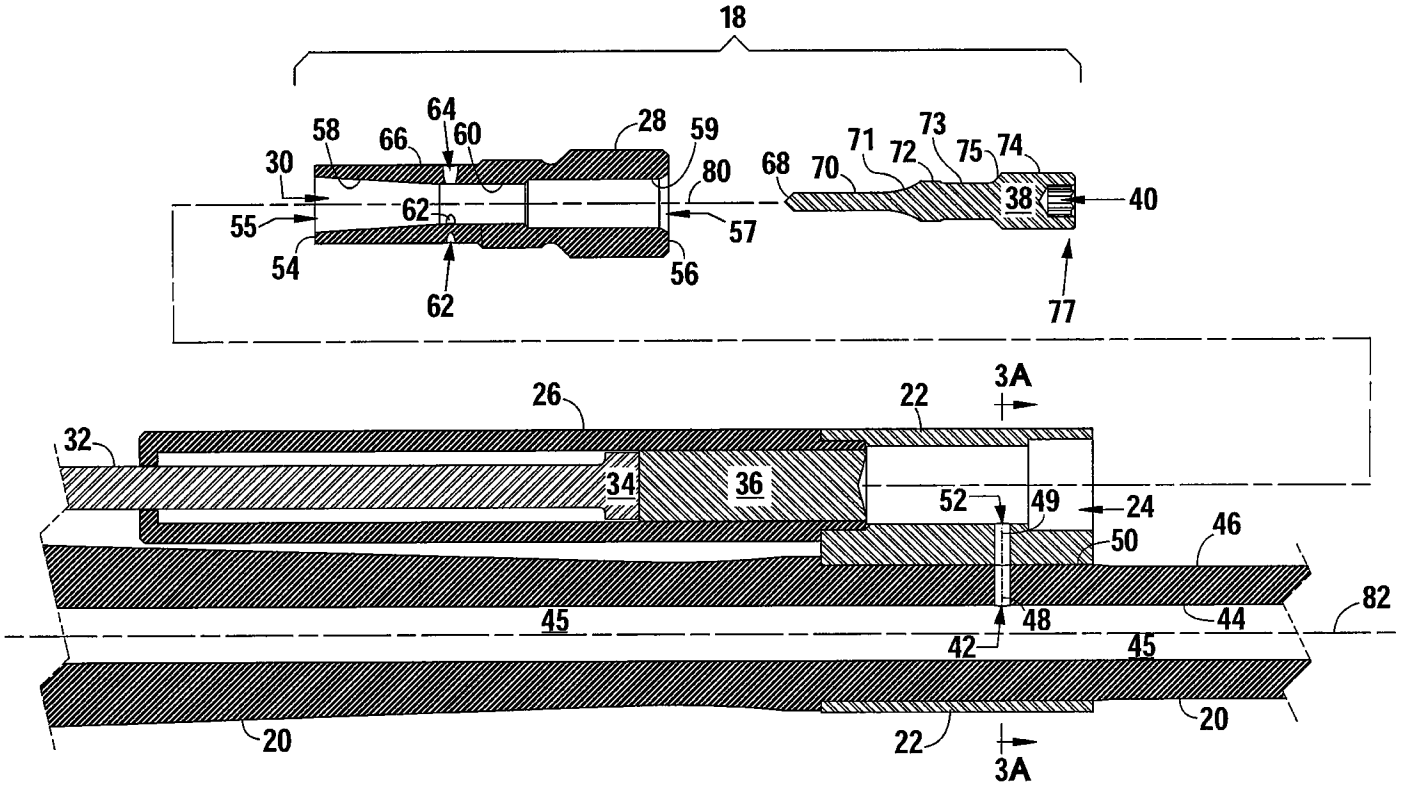
FIG. 2 is a side sectional view through a plane intersecting line 2-2 of FIG. 1.

Referring specifically to FIG. 2, the barrel 20 has a cylindrical inner surface 44 that defined a barrel interior 45 about a barrel axis 82, and an outer surface 46. A barrel channel 42 provides a gas pathway between the inner and outer surfaces 44, 46, with the axis 48 of the barrel channel 42 intersecting, and extending perpendicularly to, the barrel axis 82.

The gas block 22 has an outer surface 50 in contact with the outer surface 46 of the barrel 20. A block channel 52 provides a gas pathway between the outer surface 50 of the gas block 22 and the passage 24. An axis 49 of the block channel 52 is aligned with the barrel channel 42.

The gas valve 28 is a generally annular body positionable in the interior 24 of the gas block 22. The gas valve 28 has opposing first and second annular surfaces 54, 56 defining first and second openings 55, 57, respectively, to the chamber 30. The inner surfaces defining the chamber include a partially conical surface 58 adjacent to the first opening 55 and positioned adjacent to a cylindrical intermediate surface 60. A generally cylindrical threaded surface 59 is positioned between the intermediate surface 60 and the second opening 57. First and second gas channels 62, 64 extend from an outer surface 66 of the gas valve 28 to the cylindrical inner surface 60 to provide a gas pathway from the exterior of the gas valve 28 to the chamber 30.

The regulator 38 of this embodiment is an elongate solid body that comprises conical end surface 68. A first cylindrical surface 70 is proximal to the conical end surface 68 and adjacent to a second cylindrical surface 72, with the first and second cylindrical surfaces 70, 72 joined by a concave surface 71. A third cylindrical surface 78 is joined to the second cylindrical surface 72 by a partially conical surface. The regulator 28 has a slotted end having a threaded surface 74 connected to the third cylindrical surface 73 with a second concave surface 75. The threaded surface 74 is engagable with the threaded surface 59 of the gas valve to allow altering of the longitudinal position of the regulator 38 therein. The driver slot 40 is formed in the second end 77 of the regulator 38. A gas communication path is established between the barrel interior 45 and the chamber 30 through the barrel channel 42, block channel 52, and the first channel 62.

Figure 3A:
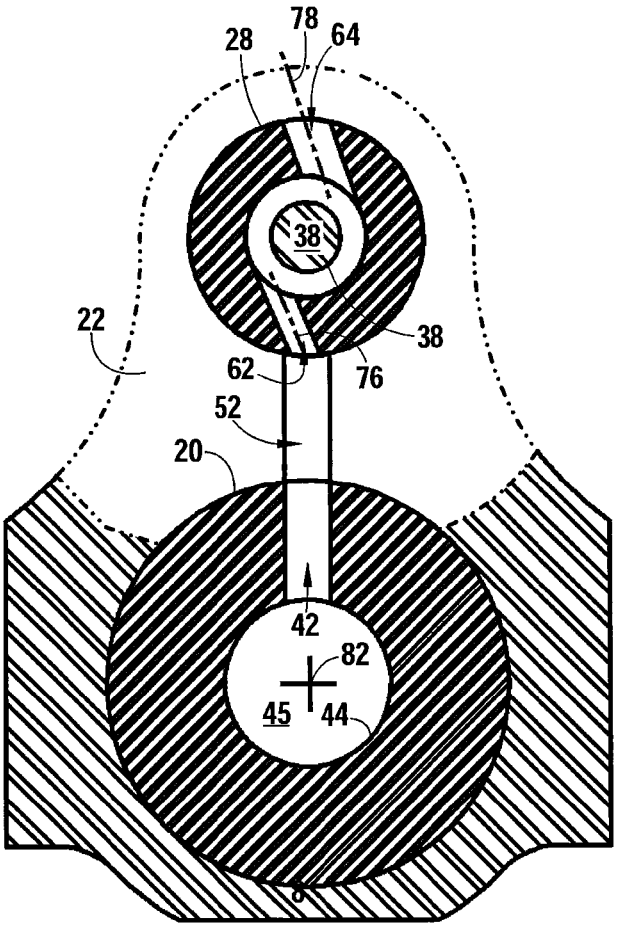
FIG. 3A is a sectional view through line 3-3 of FIG. 2.

Referring to FIG. 3A, the gas channels 62, 64, which are preferably cylindrical, have center axes 76, 78 that are angled relative to, and do not intersect with, the axis 80 of the gas valve 28. In that regard, the axes 76, 78 of the gas channels 62, 64 of this embodiment are substantially parallel to one another.

Figure 3B:
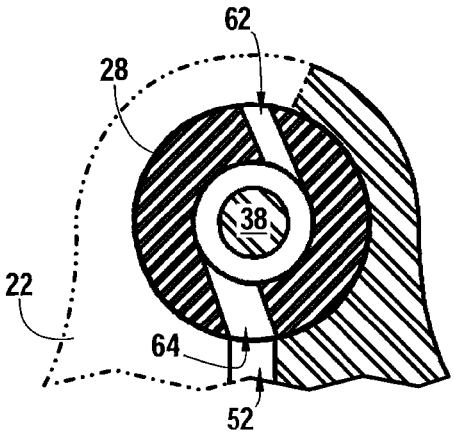
FIG. 3B is a sectional view of FIG. 3A with the regulator in an alternate configuration.

As shown in FIG. 3B, the gas valve 28 is rotatable within the gas block 22 so that either of the first or second gas channels 62, 64 may be aligned with the block channel 52 to receive gas flow therefrom. When one of the channels is aligned with the block channel 52, the other channel is misaligned with the block channel 52. Although the described embodiment comprises two gas channels 62, 64 having opposing openings, other embodiments may include any number of such gas channels alignable with the block channel 52.

Figure 4:
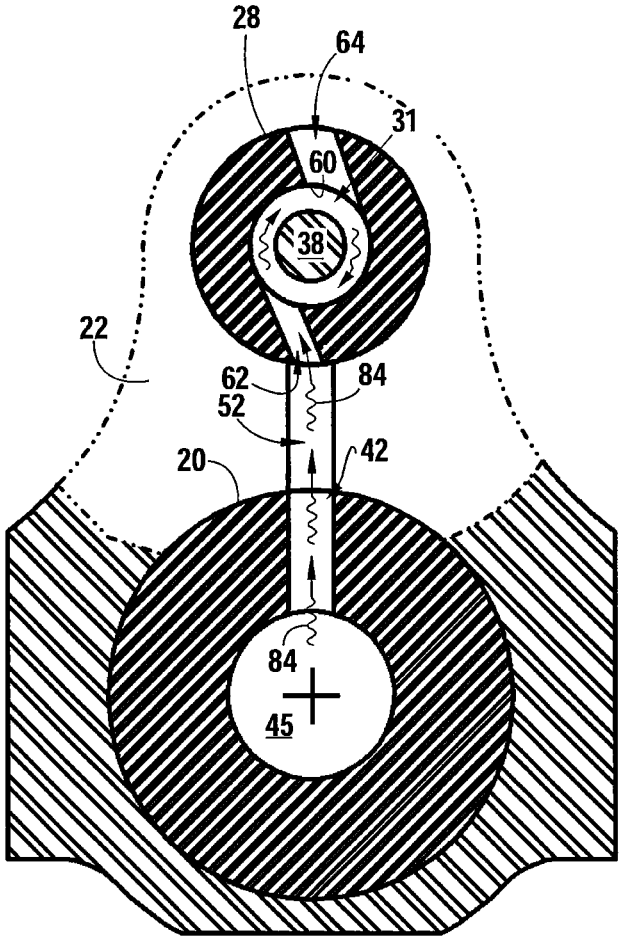
FIG. 4 shows operation of the described embodiment.

Operation of the embodiment is initially described with reference to FIG. 4. Following discharge of the firearm, a bullet moves through the barrel interior 45, causing a pressure increase in the barrel 20 from the expanding gas 84 associated with discharge. The expanding gas 84 moves through the barrel channel 42, block channel 52, and into the first channel 62 of the gas valve 28, where gas flow is introduced into the gas chamber 30 toward the intermediate surface 60. The presence of the regulator 38 within the chamber 30 defines an annular space 31 between a surface 70 of the regulator 38 and the inner surface 60, which causes the introduced gas flow to move around the annular space 31, thereby increasing the delay (when compared to generally traditional systems) before the increasing pressure operates on the piston member 36 to move the piston rod 32 away from the gas block 22 (see FIG. 2), and causing the autoloading firearm to cycle, eject, and load another ammunition cartridge.

Referring to FIG. 2, the timing of the cyclic action is at least partially a function of the operating volume of the gas chamber 30, where operating volume is the volume into which the gas can expand against the piston member 36 before leaving the chamber 30 through the first opening 55, and the path the gas travels to cause a pressure increase at the piston member 36. Thus, by introducing the gas toward the intermediate surface 60 of the gas valve 28, the gas 84 tends to move around the annular space 31. Introduction of the gas 84 into the gas chamber 30 in this manner reduces gas-flow turbulences compared to directing the gas directly toward the axis 80 and opposing side of the gas chamber 30, thus increasing gas-cyclic efficiency and overall performance of the autoloading firearm.

Figure 5A:
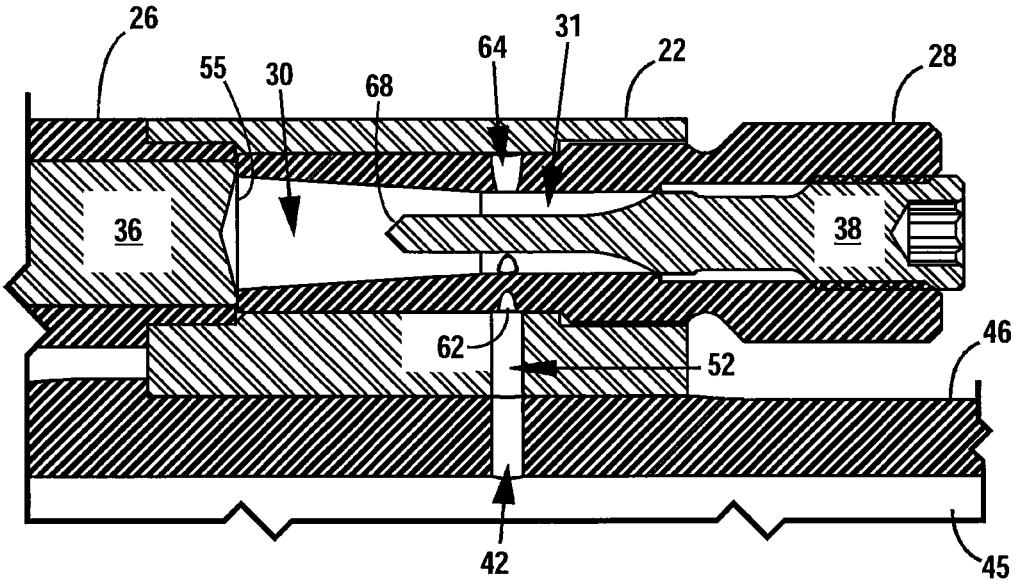
FIGS. 5A and 5B show possible positions of the regulator within the chamber of the gas valve.
Figure 5B:
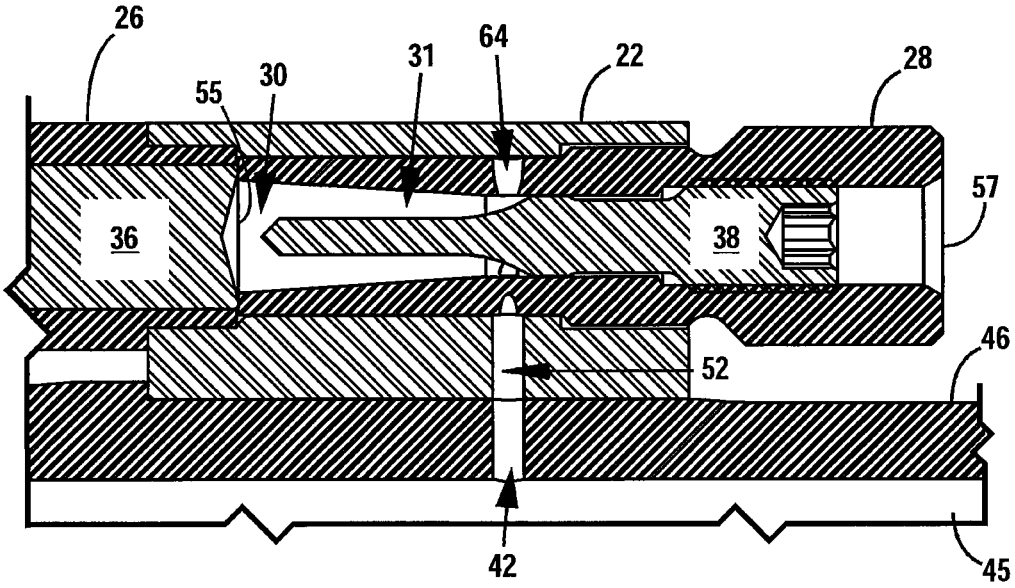

As shown in FIGS. 5A-5B, the regulator 38 is insertable into the gas chamber 30 at various positions to alter the size of the operating volume. FIG. 5A shows the regulator wherein the conical end surface 68 is at a first distance from the first opening 55. FIG. 5B shows the regulator wherein the conical end surface 68 is a second distance from the first opening 55, wherein the second distances is less than the first distance. The regulator may be moved between the positions shown in FIGS. 5A and 5B with a driving tool in conjunction with the drive slot 40 and the threaded surfaces 59, 74. The operating volume of the chamber 30 is smaller in the configuration shown in FIG. 5B than FIG. 5A. In either case, engagement of the regulator 38 with the gas valve 28 at least substantially prevents gas flow from passing through the second opening 57.

Figure 6:
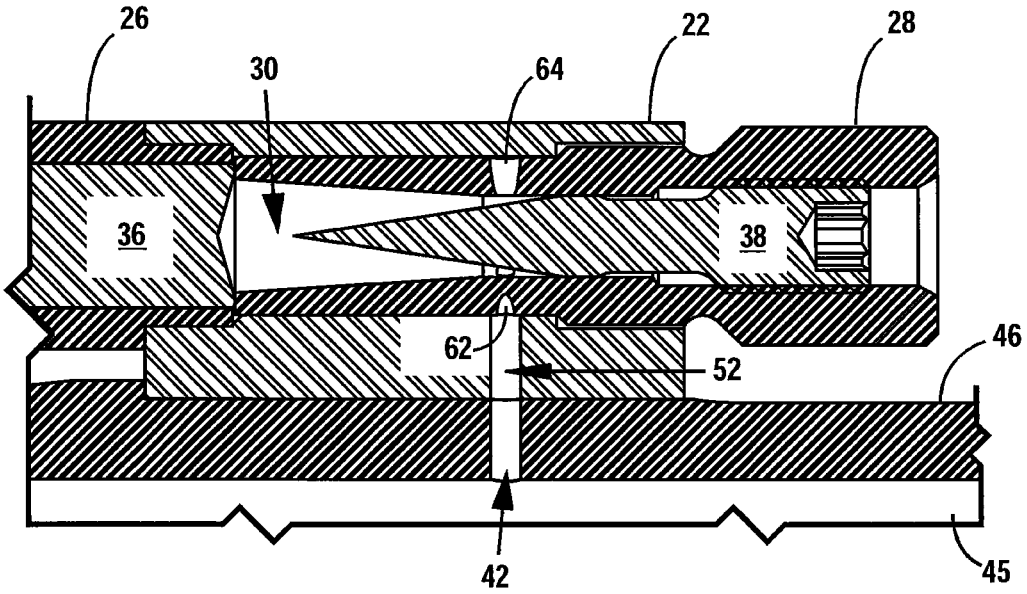
FIG. 6 shows an alternative embodiment of the regulator that includes a tapered regulator.

While the preferred embodiment shows a specifically needle-shaped regulator 38 having a partially conical surface adjacent to a cylindrical surface, other embodiments incorporate any regulator shape that substantially inhibits gas from egressing from the gas valve 28 through the second opening 57 and that does not inhibit swirling movement of the gas within the chamber 30. For example, FIG. 6 shows an alternative embodiment in which the regulator 38 has a tapered shape.

Figure 7:
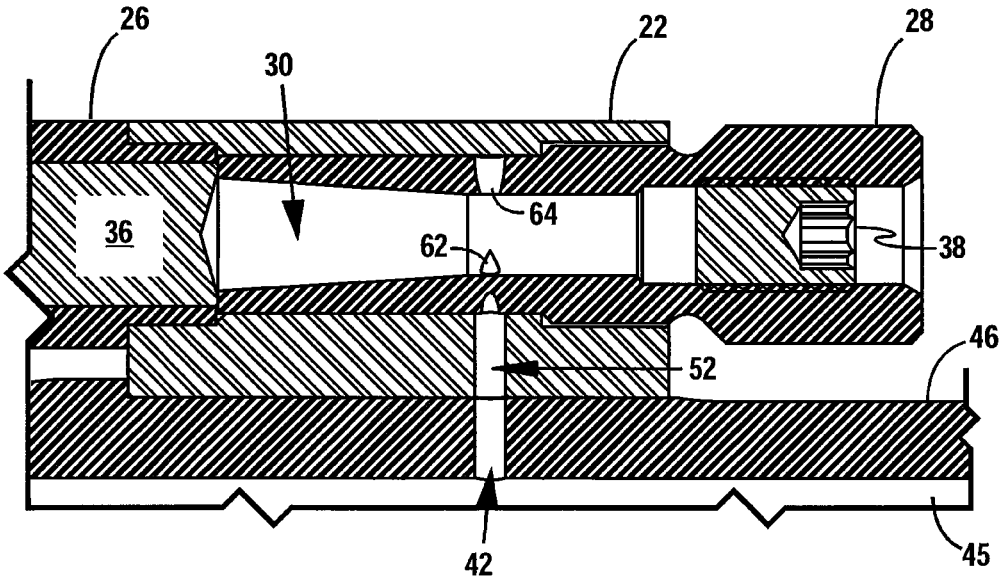
FIG. 7 shows an alternative embodiment of the regulator that is a cylindrical body.

FIG. 7 shows another alternative embodiment in which the regulator 38 is a cylindrical body. Introduction of the gas in the same manner as described with reference to FIG. 4 causes a swirling action, but the swirling action will dissipate more quickly than with the embodiments shown in FIGS. 5A and 6 because of the absence of the annular space 31.

Figure 8:
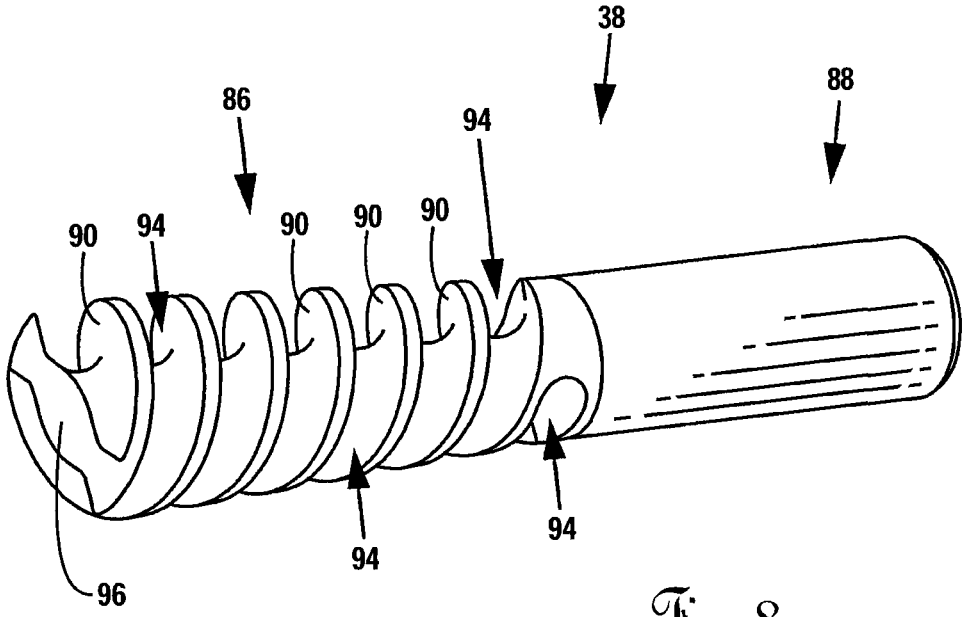
FIG. 8 shows an alternative embodiment of the regulator that includes a helical section joined to a cylindrical section, with the helical section defining a helical communication path.

FIG. 8 shows yet another alternative embodiment in which the regulator 38 comprises a helical section 86 adjacent to a cylindrical body section 88. The helical section 86 comprises first and second helical surfaces 90, 92 that form a helical communication path 94. The helical section terminates in a free end 96.

Figure 9:
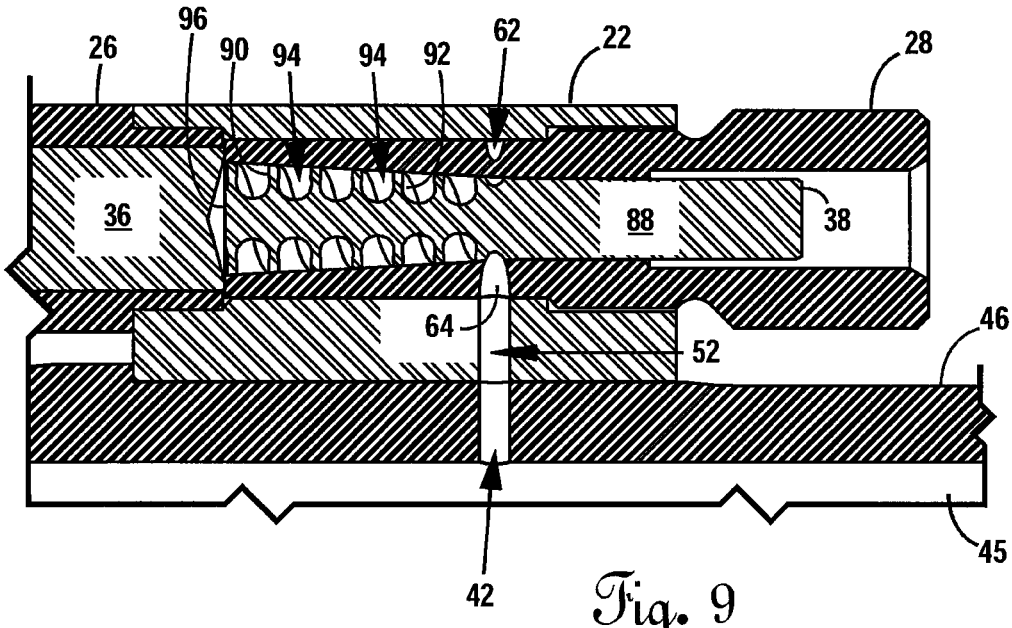
FIG. 9 shows the embodiment of the regulator shown in FIG. 8 in use with the gas block and gas valve described with reference to FIGS. 1-4.

FIG. 9 shows the regulator embodiment described with reference to FIG. 8 in use with the gas block 22 and gas valve 28 previously described. The gas valve 28 is configured to align the second gas channel 64 with the block channel 42. The helical communication path 94 extends between the opening of the second gas channel 64 to the free end 96 of the helical section 86. The distances from the center of the chamber 30 to the edge of the first and second helical surfaces 90, 92 corresponds to the inner diameter of the partially conical surface 58, such that gas flow other than through the helical communication path 94 is inhibited. The pitch and cross section of the spiral defined by the first and second helical surfaces 90, 92 can be changed to accommodate desired operating characteristics.

The present invention is described in terms of preferred and other specifically-described embodiments. Those skilled in the art will recognize that alternative embodiments of such device can be used in carrying out the present invention. Other aspects and advantages of the present invention may be obtained from a study of this disclosure and the drawings, along with the appended claims.

I claim:

1. A gas valve assembly for use in association with an autoloading firearm, the assembly comprising:

a gas valve having an annular body around a longitudinal gas valve axis, said gas valve having an inner surface defining a gas chamber and first and second annular end surfaces defining first and second openings of said gas chamber, the gas valve further having an outer surface and at least two substantially parallel gas channels spaced circumferentially equally around said inner surface, each gas channel extending between the inner surface and the outer surface and providing a gas communication path from the outer surface to the gas chamber, wherein each gas channel has a gas channel axis intersecting said inner surface at a non-zero angle of incidence and each gas channel axis lies in a first plane normal to the gas valve axis, wherein each gas channel axis does not intersect the longitudinal gas valve axis; and a regulator occupying a portion of the chamber to define an operating volume, the regulator having at least one outer diameter corresponding to an inner diameter of the gas chamber to substantially inhibit gas flow from the chamber through one of the openings.

2. The gas valve assembly of claim 1 wherein the operating volume is adjustable by changing the position of the regulator relative to the gas valve.

3. The gas valve assembly of claim 1 wherein one of said gas channels has an opening on one side of a horizontal second plane and another one of said gas channels has an opening on a second side of the second plane, said second plane intersecting said gas valve axis.

4. The gas valve assembly of claim 1 wherein the regulator has a conical surface at a first end.

5. The gas valve assembly of claim 1 wherein the regulator is a cylindrical body.

6. The gas valve assembly of claim 1 wherein the regulator comprises a helical section having a free first end and a second end adjacent to a cylindrical section, the helical section having first and second helical surfaces defining a communication path between at least one of the gas channels and the free end of the helical section.

7. The gas valve assembly of claim 1 wherein the operating volume further comprises an annular space between a portion of the regulator and an inner surface of the gas chamber.

8. The gas valve assembly of claim 1 wherein the operating volume is adjustable by changing the size and shape of the regulator relative to the gas valve.

9. The gas valve assembly of claim 8 wherein the regulator does not inhibit swirling movement of the gas within said gas chamber.

10. The gas valve assembly of claim 1 wherein the at least two gas channels have different internal diameters.

11. The gas valve assembly of claim 1 wherein said gas valve is rotatable along the gas valve axis.

12. The gas valve assembly of claim 1 wherein each gas channel axis is axially misaligned with each other gas channel axis.

13. The gas valve assembly of claim 1 wherein each gas channel has an opening intersecting the first plane.

14. The gas valve assembly of claim 1 wherein a portion of said regulator intersects the first plane, said portion having a diameter less than the outer diameter.

* * * * *